US005432223A

United States Patent [19]

Champagne et al.

[11] Patent Number: 5,432,223

[45] Date of Patent: Jul. 11, 1995

[54] SEGREGATION-FREE METALLURGICAL BLENDS CONTAINING A MODIFIED PVP BINDER

[75] Inventors: Blaise Champagne, Boucherville; Kenneth Cole, St-Hubert; Sylvain Pelletier, Ste-Julie, all of Canada

[73] Assignee: National Research Council of Canada, Ottawa, Canada

[21] Appl. No.: 291,524

[22] Filed: Aug. 16, 1994

[51] Int. Cl.[6] ..... C08K 3/08; C08K 5/3415; C22C 1/00; B22F 1/00

[52] U.S. Cl. ..... 524/431; 524/435; 524/439; 524/440; 524/441; 524/37; 523/220; 523/223; 75/255

[58] Field of Search ..... 524/431, 435, 439, 440, 524/441, 37; 523/220, 223; 75/255

[56] References Cited

U.S. PATENT DOCUMENTS 5,069,714 12/1991 Gosselin ..... 75/255
5,286,802 2/1994 Uesugi et al. ..... 524/504

*Primary Examiner*—Paul R. Michl
*Assistant Examiner*—Olga Asinovsky
*Attorney, Agent, or Firm*—Juliusz Szereszewski

[57] ABSTRACT

A novel high-performance binder system is provided for the fabrication of segregation-free iron based powder blends. The blends are prepared by using a binder system comprising thermoplastic resin polyvinylpyrrolidone and a suitable compatible plasticizer such as polyethylene glycol, and optional solid lubricants. The binder system enables the manufacture of segregation-free iron-based powder blends with high flow rate and compressibility, enhanced apparent density, green strength and transverse rupture strength, and low dimensional variations compared to unbonded powder blends and to blends made with PVP or PEG only as the binder.

11 Claims, No Drawings

SEGREGATION-FREE METALLURGICAL BLENDS CONTAINING A MODIFIED PVP BINDER

BACKGROUND OF THE INVENTION

1. Field of the Invention

The present invention relates to the production of segregation-free metallurgical powder blends comprising ferrous powders as a main constituent with additional alloying elements or compounds. In particular, the invention relates to segregation-free powder blends which contain the highly adherent film-forming thermoplastic resin polyvinylpyrrolidone (PVP) as one of the constituents of the binder system, with additions of other compatible organic compounds having the ability to produce unusual modifications with respect to film and lubrication properties, together with powdered lubricants or other additives as additional components.

2. Brief Description of the Background Art

Processes for producing metal parts from ferrous powders using powder metallurgical (P/M) techniques are well established. Such techniques typically involve mixing of ferrous powders with alloying components such as graphite, copper, nickel, or ferrophosphorus in powder form, injecting into a die, compacting and shaping of the compact by the application of pressure, and ejecting the compact from the die. The compact is then sintered wherein metallurgical bonds are developed by mass transfer under the influence of heat. The presence of an alloying element permits the attainment of strength and other mechanical properties in the sintered part which could not be reached with ferrous powders alone. When necessary, secondary operations such as sizing, coining, repressing, impregnation, infiltration, machining, joining, etc. are performed on the P/M part.

It is common practice to blend a lubricant together with the ferrous powder. This reduces friction between the pressed compact and the die walls during compaction, and this in turn lowers the ejection force that is required to remove the compact from the die. It is also common practice to incorporate with the ferrous powder minor amounts of at least one non-ferrous powder (copper, nickel, graphite, etc.) to achieve desired physical and metallurgical properties in the final sintered products. Additionally, minor amounts of other additives may be utilized together with the ferrous powder to achieve the desired properties in the sintered products. The lubricants, alloying powders and other additives may be used together and are collectively referred to herein as secondary powders. These secondary powders typically differ from the basic ferrous powder in particle size, shape and density and make these powder mixtures susceptible to the undesirable separatory phenomena of segregation, lining and dusting during handling of the mixture. The dynamics of handling the powder mixture during storage and transfer can cause the smaller alloying powder particles to migrate through the interstices of the ferrous powder matrix. The normal force of gravity, particularly where the alloying powder is denser than the iron powder, can cause the alloying powder to migrate downwardly toward the bottom of the mixture's container, resulting in a loss of homogeneity of the mixture or its segregation. On the other hand, the smaller alloying powders, particularly if they are less dense than the iron powders, can migrate upwardly.

Organic binding agents are sometimes added to powder blends for critical applications requiring a wide array of specific properties. One important objective of binder addition is the reduction or elimination of segregation and dusting. For example, in U.S. Pat. No. 4,483,905, Engstroöm selects a binder from the group consisting of polyethylene glycol, polypropylene glycol, glycerine and polyvinyl alcohol to bind the finer alloying powder to coarser iron-based particles to prevent segregation and dusting. In U.S. Pat. No. 4,504,441, Kuyper selects furfuryl alcohol and an acid sufficient to polymerize said alcohol during blending to produce a dry and free-flowing powder metal blend. In U.S. Pat. No. 4,676,831, Engström uses tall oil to prevent segregation and dusting. In U.S. Pat. No. 4,834,800, Semel uses resins substantially insoluble in water such as homopolymer of vinyl acetate or copolymers of vinyl acetate. In U.S. Pat. No. 5,069,714, Gosselin uses the water-soluble resin polyvinylpyrrolidone to prevent lining, dusting and/or segregation of the composition. In U.S. Pat. No. 5,132,338, Hayami uses a blend of acrylic acid ester, methacrylic ester and a polymerizable unsaturated acid as a binder to prevent graphite segregation. These binders are effective in preventing lining, segregation and dusting but they sometimes adversely affect other physical properties such as compressibility and flow of the powder, even when present in only small amounts.

A few patents provide for reduction or elimination of segregation and dusting while at the same time offering improvement, or at least no degradation, of physical and metallurgical properties. For example, in U.S. Pat. No. 5,290,336, Luk uses a binder/lubricant system that comprises a dibasic organic acid and one or more additional components such as solid polyethers, liquid polyethers, and acrylic resin to enhance the green properties of the powder compositions and reduce the ejection force required to remove the compact from the molds and dies. Also, in U.S. Pat. No. 5,298,055 Semel and Luk use polyalkylene oxide having a number average molecular weight of at least about 7,000 as a binder to achieve compressibility equivalent to that of unbonded compositions without increasing die ejection forces, while at the same time maintaining resistance to dusting and segregation of the alloying powder and providing lubricity during compaction of the alloying powder.

The binder systems of the prior art present certain disadvantages. In almost all cases, improvement of the segregation and dusting properties is accompanied by a deterioration in one or more physical or mechanical properties. Furthermore, many of the proposed polymeric binders have limited solubility and require the use of expensive and/or highly toxic solvents.

SUMMARY OF THE INVENTION

It has been found that the physical properties such as compressibility, green strength and resistance to segregation and dusting of iron based powder blends capable of being formed in a die can be improved while its flow and metallurgical properties are maintained, as compared to powder compositions containing polyvinylpyrrolidone as binder of the prior art, or can be kept equivalent to the physical and metallurgical properties of conventional powder compositions of the prior art, when the composition comprises polyvinylpyrrolidone (PVP) as a binder and at least one -plasticizer selected from the group consisting of diols and polyols such as polyethylene glycol, glycerin and its esters, esters of organic diacids, sorbitol, phosphate esters, cellulose esters, arylsulfonamide-formaldehyde resins, and long chain alcohols.

In a specific embodiment of the invention, the metallurgical powder compositions comprise a blend of metal powder having a maximum particle size of generally about 300 microns and at least one of (i) an alloying powder in the amount of less than about 15 weight percent, (ii) a solid lubricant in amount of less than about 5 weight percent and (iii) an additive in the amount of less than about 5 percent, said composition further comprising a binding agent for preventing the alloying powder, additive or lubricant from segregation from said composition, said binding agent comprising polyvinylpyrrolidone and at least one plasticizer suitable to reduce the rigidity of the PVP.

The details of the preferred embodiments of the compositions of the invention are given below.

DETAILED DESCRIPTION OF THE INVENTION

The organic compounds used to modify the PVP resin may be chosen from a wide range of materials known to be compatible with PVP and to reduce its hardness and improve its flexibility and plasticity. Examples of such compounds, without disclosing nor suggesting their anti-segregation advantages in the context of metal powders, are given by Blecher et al., Polyvinylpyrrolidone, Chapter 21 in Handbook of Water-Soluble Gums and Resins, McGraw-Hill, 1980, and by Sears and Darby, The Technology of Plasticizers, John Wiley & Sons, 1982, Table A.8b. The possibilities include, but are not limited to: diols and polyols such as polyethylene glycol with molecular weight generally lower than 10000, glycerin and its esters, esters of organic diacids, sorbitol, phosphate esters, cellulose esters, arylsulfonamide-formaldehyde resins, and long chain alcohols. Such compounds, upon forming an intimate blend with the PVP, modify its plasticity and hence its behaviour on compression, thus improving the overall compressibility of the metal powder blend while at the same time maintaining or improving the other properties. The amount of organic compound added to the PVP should be sufficient to modify the characteristics of the binder system and improve the P/M metallurgical and physical properties of the powder blend, such as flow, green strength, sintered strength, etc., while maintaining its segregation-free and low-dusting nature. Generally, the total amount of plasticizer added will be from 5–500 parts by weight per 100 parts PVP, preferably from 25–300 parts by weight par 100 parts PVP, more preferably from 50–200 parts by weight per 100 parts PVP and most preferably from 75–150 parts by weight per 100 parts PVP. These plasticizers can be added to PVP singly or in various combinations.

Polyvinylpyrrolidone alone, as mentioned in the Background of the Invention, above, was proposed as a binder by Gosselin in U.S. Pat. No. 5,069,714. However, applicants have determined that PVP forms hard films that interfere with compaction of the ferrous powder mixture. Also, it has been demonstrated by F. Gosselin et al., that the use of polyethylene glycol (PEG) alone as a binder decreases the flowability of the blends; they are in fact non free-flowing at addition levels of PEG necessary to obtain acceptable resistance to dusting ("Segregation-free blends:processing parameters and product properties", International Conference on Powder Metallurgy in London, 1990, Published by The Institute of Metals, 1990, pp 297–303). This was also confirmed by Engstrom in U.S. Pat. No. 4,676,831. Thus, PEG alone cannot be used as a binder. Surprisingly, the addition of an organic compound as in the present invention reduces the rigidity of the polymer and improves the compressibility of the powder mixes without detriment to other properties.

A further advantage of the present invention, as compared to non-PVP binder systems, is that the binder components are readily soluble in simple, inexpensive solvents such as methanol and ethanol.

The metallurgical powder compositions of the invention comprise a mixture of metal powders having a maximum particle size of generally about 300 microns and at least one of (i) an alloying powder in the amount of less than 15 weight percent, (ii) a solid lubricant in amount of less than about 5 weight percent and (iii) an additive in the amount of less than about 5 percent, said composition further comprising a binding agent for preventing the alloying powder, additive or lubricant from segregating from said composition, said binding agent comprising polyvinylpyrrolidone and an organic compound to reduce the rigidity of the PVP, said organic compound comprising for instance polyethylene glycol of low to medium molecular weight.

The ferrous powders employed in the present invention are any of the pure iron or iron-containing (including steel or ferromagnetic) powders generally used in powder metallurgical methods, which are typically made by discharging molten steel metal from a ladle into a tundish where, after passing through refractory nozzles, the molten steel is subjected to atomization by high-pressure water jets. The atomized steel is then dried and subsequently annealed to remove oxygen and carbon. The pure cake which is recovered is then crushed back to a powder. Examples are powders of substantially pure iron or iron pre-alloyed with other elements (for example, steel-producing elements) that enhance the strength, hardenability, electromagnetic properties, or other desirable properties of the final product. Essentially any ferrous powder having a maximum particle size less than about 300 microns can be used in the composition of the invention. Typical ferrous powders are steel powders including stainless and alloyed steel powders. Atomet® 1001 steel powders manufactured by Quebec Metal Powders Limited of Tracy, Quebec, Canada are representative of the steel alloyed powders. These Atomet® powders contain in excess of 99 weight percent iron, less than 0.2 weight percent oxygen and 0.1 weight percent carbon, and have an apparent density of 2.50 g/cm$^3$ and a flow rate of less than 30 seconds per 50 g. Virtually any grade of steel can be used.

While the binder (polyvinylpyrrolidone and plasticizer) of this invention were found to be effective using Atomet® steel powder, others metal powders can also be used as the ferrous powders for the blends of this invention.

In accordance with the present invention, PVP is added to the ferrous powder blend in an amount of not more than about 0.2 wt. % (dry), desirably not more than about 0.15 wt. % and preferably not more than about 0.1 wt. %.

In accordance with the present invention, the binder comprises a plasticizer, e.g. PEG, in an amount of less than about 0.5 weight percent, preferably less than about 0.15 weight percent of the composition.

The secondary materials contained in this invention include alloying agents (powders) such as graphite and other metallurgical carbons, copper, nickel, molybdenum, sulfur or tin, as well as various other suitable nonmetallic additives such as for instance ferrophosphorus, talc, boron nitride and the like. The amount of the nonmetallic additives is less than about 5 weight percent.

Generally, the total amount of alloying powder present is less than 15% by weight and usually less than 10% by weight. In most applications, less than about 3% by weight of alloying powder will be included in the powder blends of this invention. Most commonly, the maximum particle size of the alloying agent (powder) will be not larger than that of the base metal powder. Desirably, the maximum particle size of the alloying agent will be less than about 150 microns, preferably about 50 microns. Most preferably, the average particle size of the alloying agent will be at most about 20 microns.

Other secondary materials which are commonly incorporated are also well known to those skilled in the art and include, for instance, lubricants such as zinc stearate, stearic acid, wax, or machinability improving additives such as boron nitride and manganese sulfide, etc. Such additives are typically utilized in the blended powders at up to about 5% by weight. Preferably, they are present at less than about 2% by weight and most preferably, at less than about 1% by weight. The lubricant will typically have an average particle diameter of not more than about 100 microns and preferably, not more than about 50 microns. In this regard, if the additives are utilized in the form of agglomerates, the above size limitations refer to the average particle sizes of such agglomerates.

Various other materials, including other binding agents, which are conventionally known in the art may also be used.

SPECIFIC EMBODIMENTS AND EXAMPLES

Binders and plasticizers were dissolved in an appropriate solvent and sprayed in the powder mixture as a fine mist. After homogenization in a blender, the mixture was dried by evaporating the solvent (with or without the aid of vacuum) and recovering the removed solvent by condensation for recycling. Evaporation of the solvent causes product temperature to decrease, lowering the evaporation rate and augmenting drying time. By circulating a liquid at a controlled temperature through a jacket of the blender, product temperature can be maintained and drying times can be reduced while maintaining the temperature below the melting point of the additives.

Experimental tests were conducted in accordance with a Taguchi plan whereby 18 different trials were carried out to study the effect of several parameters. This has led to the unexpected discovery of high performance binder system for the fabrication of segregation-free iron based powder blends.

Atomet® 1001 steel powder was used as the base material, to which was added 1.3% by weight of ferrophosphorus (QMP grade), 0.7% by weight of South Western 1651 graphite, 1.0% by weight of Inco 123 nickel in order to have a total content of alloying elements and additives of 3% by weight. Table 1 gives the composition of four different iron powder mixes. Comparative examples 2 and 3 are designated as unbonded mixes since they have respectively the same composition as example 1 and comparative example 1, except that no binder was added. The binding agent employed for comparative example 1 was polyvinylpyrrolidone (GAF: PVP K30) as used by Gosselin. The binder system used for powder mix of example 1 is based on the present invention and contains a mixture of polyvinylpyrrolidone (GAF: PVP K30) and a polyethylene glycol plasticizer (Union Carbide: Carbowax PEG with average molecular weight approximately 1450).

TABLE 1

Composition of Iron Powder Mixes with Low Content of Additives

| Composition | Example 1 (wt %) | Comparative example # 1 | 2 (wt %) | 3 |
|---|---|---|---|---|
| Ferrophosphorus (QMP Grade) | 1.3 | 1.3 | 1.3 | 1.3 |
| Atomet ® 1001 | 97 | 97 | 97 | 97 |
| Graphite (SW-1651) | 0.7 | 0.7 | 0.7 | 0.7 |
| Nickel (Inco 123) | 1.0 | 1.0 | 1.0 | 1.0 |
| Binder and plasticizer | | | | |
| PVP (GAF K30) | 0.10 | 0.10 | 0.0 | 0.0 |
| PEG (Carbowax PEG 1450)* | 0.11 | 0.0 | 0.0 | 0.0 |
| Lubricant | | | | |
| Acrawax C | 0.64 | 0.75 | 0.75 | 0.64 |

*The influence of the molecular weight of polyethylene glycol on the results was also assessed although detailed results are not reported herein in detail. PEG of varying molecular weight was tested in equal conditions. The best results were obtained with polyethylene glycol of low-to-medium molecular weight.

The binder and plasticizer were dissolved in methanol to a solids concentration of 10 wt %. For the solvent recovery system, total drying time was measured as a function of temperature of the heating/cooling system. This system controls the temperature of the incoming oil that circulates throughout the jacket of the blender making it possible to evaporate the solvent. The preparation of mixes comprises the following steps:

1) addition of the steel powder into the blender
2) addition of the alloying elements (powders) and additives
3) addition of the lubricant
4) injection of the binder/plasticizer/solvent solution
5) extraction of the solvent under vacuum.

The steel powder and the alloying additives were blended for fifteen minutes at fifteen revolutions per minute in a Patterson-Kelly blender. The temperature of the circulating oil through the jacket of the blender was controlled and kept at 40 degrees Celsius. The lubricant was then added to the blend of iron powder and additives, and mixed for fifteen additional minutes at fifteen revolutions per minute. A reference sample was taken after that step. The binder or the binder/plasticizer solution was then, during blending, fed by gravity and sprayed into the blender through a dispersion bar which rotated about the horizontal axis of the blender. The blending continued for ten minutes at fifteen revolutions per minute. The powder mixture was then dried using a vacuum system coupled to the blender. The vacuum system fed evaporated solvent to a condensation chamber maintained at minus 20 degrees Celsius to recover the solvent. The drying time was recorded and the quantity of solvent recovered was calculated. The typical drying time was just under thirty minutes for a total powder mix of 68 kg.

The effect of the binder and plasticizer on the resistance to dusting was determined by fluidization with a stream of gas (air, $N_2$, etc.). Air was directed at a constant flow rate of 6.0 liters/minute for ten minutes through a 2.5 cm diameter tube with a 400 mesh screen upon which the test material was placed. This causes the dust, such as graphite, to be entrained, as a result of a large surface-to-volume ratio and low specific gravity, and deposited in the dust collector. The dust was then weighted.

The apparent density (MPIF 04 or ASTM B212) and flow rate (MPIF 03 or ASTM B213) of the powder composition of each example were also determined. The mixes were pressed into green bars at 50 tons/in$^2$ at ambient temperature (20° C.) and the green strength (MPIF 15 or ASTM B312) was measured. A second set of green bars was pressed to a density of 6.8 g/cm$^3$ and then sintered at 1120° C. in dissociated ammonia for 30 minutes, after which the dimensional change (MPIF 44 or ASTM B610) and transverse rupture strength (MPIF 41 or ASTM B528) were determined.

The properties of above-mentioned mixes are presented in Table 2. As compared to unbonded mixes of comparative examples 2 and 3, bonded mixes possess a high resistance to dusting and can flow. It is worthy to note that the binder system proposed in the present invention (example 1) has the best performance. In terms of green properties, example 1 based on the binder system of the present invention can be compacted to a density of 6.8 g/cm$^3$ with pressures equivalent to those normally required for unbonded mixes and has also green strength similar to those normally observed for unbounded mixes. The comparative example 1 based on PVP alone cannot maintain green properties equivalent to those of unbounded mixes (comparative examples 2 and 3). The metallurgical properties of the bonded mix of example 1 based on the present binder/-plasticizer system are not deteriorated compared to an unbonded mix (comparative example 3).

TABLE 2

Properties of Iron Powder Mixes with a Low Content of Alloying Elements and Additives

| Properties | Example 1 (wt %) | Comparative example 1 | 2 (wt %) | 3 |
|---|---|---|---|---|
| Dust resistance | | | | |
| Graphite (%) | 80 | 77 | 59 | 58 |
| Powder properties | | | | |
| Apparent density (g/cm$^3$) | 3.02 | 3.02 | 3.10 | 3.10 |
| Hall flow (s/50 g) | 29.8 | 30.4 | * | * |
| Green properties (6.8 g/cm$^3$) | | | | |
| Compacting pressure (MPa) | 403 | 414 | 401 | 404 |
| Green strength (Mpa) | 9.9 | 8.9 | 10.0 | 9.9 |
| Metallurgical properties (6.8 g/cm$^3$) | | | | |
| Dimensional Change vs Die (%) | .21 | .21 | 0.25 | 0.25 |
| Trans. Rupture Strength (MPa) | 827 | 818 | 819 | 831 |
| Rockwell Hardness ($R_b$) | 68 | 68 | 67 | 69 |

*No flow

Table 3 shows the composition of four different iron powder mixes with a high content of alloying elements and additives (7 wt %). Example 2 and comparative example 4 mixes correspond to bonded mixes, respectively with a PVP/PEG binder system of the present invention and with PVP alone, as taught by Gosselin. Comparative examples 5 and 6 are the unbonded mixes with composition respectively similar to example 2 and comparative example 5. All these mixes were prepared in accordance with the same procedure as previously described.

TABLE 3

Composition of Iron Povder Mixes with a High Content of Alloying Elements and Additives

| Composition | Example 2 (wt %) | Comparative example # 4 | 5 (wt %) | 6 |
|---|---|---|---|---|
| Copper (SCM 500 RL) | 3.0 | 3.0 | 3.0 | 3.0 |
| Ferrophosphorus (QMP grade) | 2.3 | 2.3 | 2.3 | 2.3 |
| Atomet TM 1001 | 93 | 93 | 93 | 93 |
| Graphite (SW-1651) | 0.7 | 0.7 | 0.7 | 0.7 |
| Nickel (Inco 123) | 1.0 | 1.0 | 1.0 | 1.0 |
| Binder and plasticizer | | | | |
| PVP (GAF K30) | 0.10 | 0.10 | 0.0 | 0.0 |
| PEG (Carbowax PEG 1450) | 0.11 | 0.0 | 0.0 | 0.0 |
| Lubricant | | | | |
| Acrawax C | 0.64 | 0.75 | 0.75 | 0.64 |

The resulting properties of mixes are given in Table 4.

TABLE 4

Properties of Iron Powder Mixes with a High Content of Alloying Elements and Additives

| Properties | Example 2 (wt %) | Comparative example # 4 | 5 (wt %) | 6 |
|---|---|---|---|---|
| Dust resistance | | | | |
| Graphite (%) | 78 | 76 | 52 | 50 |
| Powder properties | | | | |
| Apparent density (g/cm$^3$) | 3.04 | 3.20 | 3.12 | 3.14 |
| Hall flow (s/50 g) | 31.8 | 29.0 | * | * |
| Green properties (6.8 g/cm$^3$) | | | | |
| Compacting pressure (MPa) | 393 | 407 | 397 | 394 |
| Green strength (MPa) | 9.9 | 8.9 | 10.1 | 10.1 |
| Metallurgical properties (6.8 g/cm$^3$) | | | | |
| Dimensional Change vs Die (%) | .55 | .57 | 0.59 | 0.60 |
| Trans. Rupture Strength (MPa) | 1049 | 1052 | 1033 | 1042 |
| Rockwell Hardness ($R_b$) | 85 | 87 | 85 | 87 |

The comparison of the properties of the bonded mix (example 2) based on the present invention with those of the unbonded mix (comparative example 6) shows that the binder system of the present invention significantly improves dust resistance, compressibility, flow and green strength. The bonded mix (example 2) based on the present invention shows no deterioration of metallurgical properties compared to the comparative mix example 6. It is to note that the use of PVP alone cannot achieve such a superior combination of dust resistance, powder properties, green properties with no deterioration of metallurgical properties.

Similar results as obtained with the use of PEG are expected by the inventors when the other organic plasticizers discussed above are utilized to reduce the hardness of PVP and improve its flexibility in the compositions of the present invention as described in the following claims.

We claim:

1. A metallurgical powder composition capable of being formed in a die, said powder composition being uniformly blended and comprising a ferrous powder, at least one secondary non-ferrous powder and a binding agent for preventing the secondary powder from segregating from the said composition, said binding agent comprising polyvinylpyrrolidone and a plasticizer selected from the group consisting of diols and polyols such as polyethylene glycol, glycerin and its esters, esters of organic diacids, sorbitol, phosphate esters, cellulose esters, arylsulfonamide-formaldehyde resins, and long chain alcohols.

2. The composition according to claim 1 wherein said secondary non-ferrous powder comprises a nonferrous alloying powder and a lubricant.

3. The composition according to claim 1 wherein the content of polyvinylpyrrolidone is not more than about 0.2 weight percent.

4. The composition according to claim 3 wherein the content of the plasticizer is not more than about 0.5 weight percent.

5. The composition according to claim 1 wherein the plasticizer is polyethylene glycol of low-to-medium molecular weight.

6. A metallurgical powder composition capable of being formed in a die, said powder composition being uniformly blended and comprising a ferrous powder and at least one of i) an alloying powder in the amount of less than about 15 weight percent, ii) a lubricant in the amount of less than about 5 weight percent and a non-metallic additive in the amount of less than 5 weight percent, said composition further comprising a binding agent for preventing said composition from segregating, the binding agent comprising polyvinylpyrrolidone and a plasticizer selected from the group consisting of diols and polyols such as polyethylene glycol, glycerin and its esters, esters of organic diacids, sorbitol, phosphate esters, cellulose esters, arylsulfonamide-formaldehyde resins, and long chain alcohols, said plasticizer being soluble in ethanol or methanol.

7. The composition of claim 6 wherein said plasticizer is polyethylene glycol of low-to-medium molecular weight.

8. The composition according to claim 6 wherein said polyvinylpyrrolidone is present in an amount of less than about 0.2 weight percent.

9. The composition according to claim 6 wherein said plasticizer is present in an amount of less than about 0.5 weight percent.

10. The composition according to claim 6 wherein said plasticizer is present in an amount of less than about 0.15 weight percent.

11. The composition according to claim 6 wherein said polyvinylpyrrolidone is present in an amount of not more than about 0.15 weight percent.

* * * * *